US008651348B2

(12) United States Patent
Meng

(10) Patent No.: US 8,651,348 B2
(45) Date of Patent: Feb. 18, 2014

(54) TOOL BOX

(76) Inventor: Ji-Fen Meng, Taichung (TW)

( * ) Notice: Subject to any disclaimer, the term of this patent is extended or adjusted under 35 U.S.C. 154(b) by 169 days.

(21) Appl. No.: 13/457,489

(22) Filed: Apr. 27, 2012

(65) Prior Publication Data

US 2013/0284773 A1 Oct. 31, 2013

(51) Int. Cl.
*A45F 5/00* (2006.01)
*B65D 85/20* (2006.01)
*B65D 85/28* (2006.01)

(52) U.S. Cl.
USPC ..... 224/245; 224/242; 224/668; 206/379; 206/743

(58) Field of Classification Search
USPC ..... 224/196, 242, 245, 282, 666, 668, 904; 206/349, 372, 373, 378, 379, 751, 752, 206/754, 755; 220/843
See application file for complete search history.

(56) References Cited

U.S. PATENT DOCUMENTS 7,021,464 B2 * 4/2006 Chen ..... 206/379
7,188,726 B2 * 3/2007 Lin ..... 206/373
7,328,797 B2 * 2/2008 Lin ..... 206/379

* cited by examiner

*Primary Examiner* — Adam Waggenspack

(57) ABSTRACT

A tool box includes a box body having a top cover and a bottom cover which are pivoting on each other, two foldable sets which are both assembled to the top cover and the bottom cover, at least one positioning base is assembled between the two foldable sets. Under this arrangement, the positioning base can be rotated outward relative to the bottom cover by the operation of the two foldable sets. Therefore, the user can pull out the tool bit from the positioning base directly without bending up the tool bit by the finger thereof at first.

9 Claims, 8 Drawing Sheets

TOOL BOX

BACKGROUND OF THE INVENTION

1. Field of the Invention

The present invention relates to a box and more particularly to a tool box which has a foldable set.

2. Description of Related Art

Hand tools are ordinary and widely using in houses and factories. People often assemble and fix things by using the hand tool with various tool bits. Therefore, a tool box can make a user more convenient to carry the hand tool and those various tool bits.

A conventional tool box comprises a box. The box has a top cover and a bottom cover which are pivoted on each other. A plurality of receiving grooves is uniformly and horizontally defined on an inner surface of the bottom cover. The receiving grooves are respectively corresponding to the tool bits. Under this arrangement, the tool bits are respectively received on the receiving grooves horizontally, and the user closes the conventional tool box to carry the tool bits conveniently. However, the conventional tool box still has two disadvantages as following:

First, each receiving groove occupies large area of the inner surface of the bottom cover because the receiving groove is horizontally defined on the inner surface of the bottom cover. Therefore, the bottom cover cannot contain more receiving grooves and the amount of receiving grooves is not enough to receive more tool bits.

Second, when the user wants to take out the tool bit from the receiving groove, the user must bend up the tool bit by a finger at first, and then pull out the tool bit from the receiving groove rather than pull out the tool bit from the receiving groove directly, because the tool bit is horizontally received on the receiving groove. Therefore, the user spends much time and energy on taking out the tool bit from the receiving groove of the conventional tool box.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved tool box.

To achieve the objective, a tool box in accordance with the present invention comprises a box body, two foldable sets and at least one positioning base, the box body having a top cover and a bottom cover which are pivoting on each other, each foldable set having a guiding plate, a sliding member and a pivoting rib, the guiding plate is assembled at a pivoting corner of the bottom cover, a guiding opening opened on the guiding plate therethrough and formed as arc-shaped, two ends of the positioning base respectively assembled to the two guiding plates, the sliding member located at one side of the guiding plate, at least one connecting rod extruded on the sliding member, the connecting rod passing through the guiding opening to connect to one end of the positioning base, the pivoting rib located at one side of the guiding plate and being adjacent to the sliding member, one end of the pivoting rib pivoted on the guiding plate at one side thereof and fixed to the top cover at another side thereof, another end of the pivoting rib being adjacent to the sliding member, the sliding member being movable via the motion of another end of the pivoting rib. Wherein, a clipping plate is assembled to the bottom of the bottom cover; a clipping space is defined between one side of the clipping space and the bottom of the bottom cover; a buckle groove is defined on the top of the bottom cover; a hanging plate is assembled to the top of the bottom cover; the hanging plate has a through opening opened at a bottom end thereof; the through opening is corresponding to the buckle groove; a hanging opening is opened at a top end of the hanging plate therethrough; the top cover has a buckle unit which is corresponding to the buckle groove of the bottom cover; the buckle unit passes through the through opening to be buckled into the buckle groove; the sliding member further has a guiding groove defined thereon; the guiding groove is formed as arc-shaped; another end of the pivoting rib is assembled in the guiding groove; at least one bar groove is defined at each end of the positioning base; the connecting rod passes through the guiding opening to be inserted into the bar groove of the positioning base; an abutting protrusion is further extruded along one side of the guiding opening on the guiding plate; the abutting protrusion is adjacent to the periphery of the guiding plate; the sliding member abuts against the abutting protrusion.

Under this arrangement, when the top cover pivots on the bottom cover, the pivoting rib pivots on the guiding plate via the motion of the top cover; then the sliding member slides on the guiding plate via the motion of another end of the pivoting rib; thereafter the connecting rod of the sliding member moves along the guiding opening of the guiding plate; finally the positioning base is rotated outward relative to the bottom cover by the motion of the connecting rod.

Further benefits and advantages of the present invention will become apparent after a careful reading of the detailed description with appropriate reference to the accompanying drawings.

DETAILED DESCRIPTION OF THE INVENTION

Figure 1:
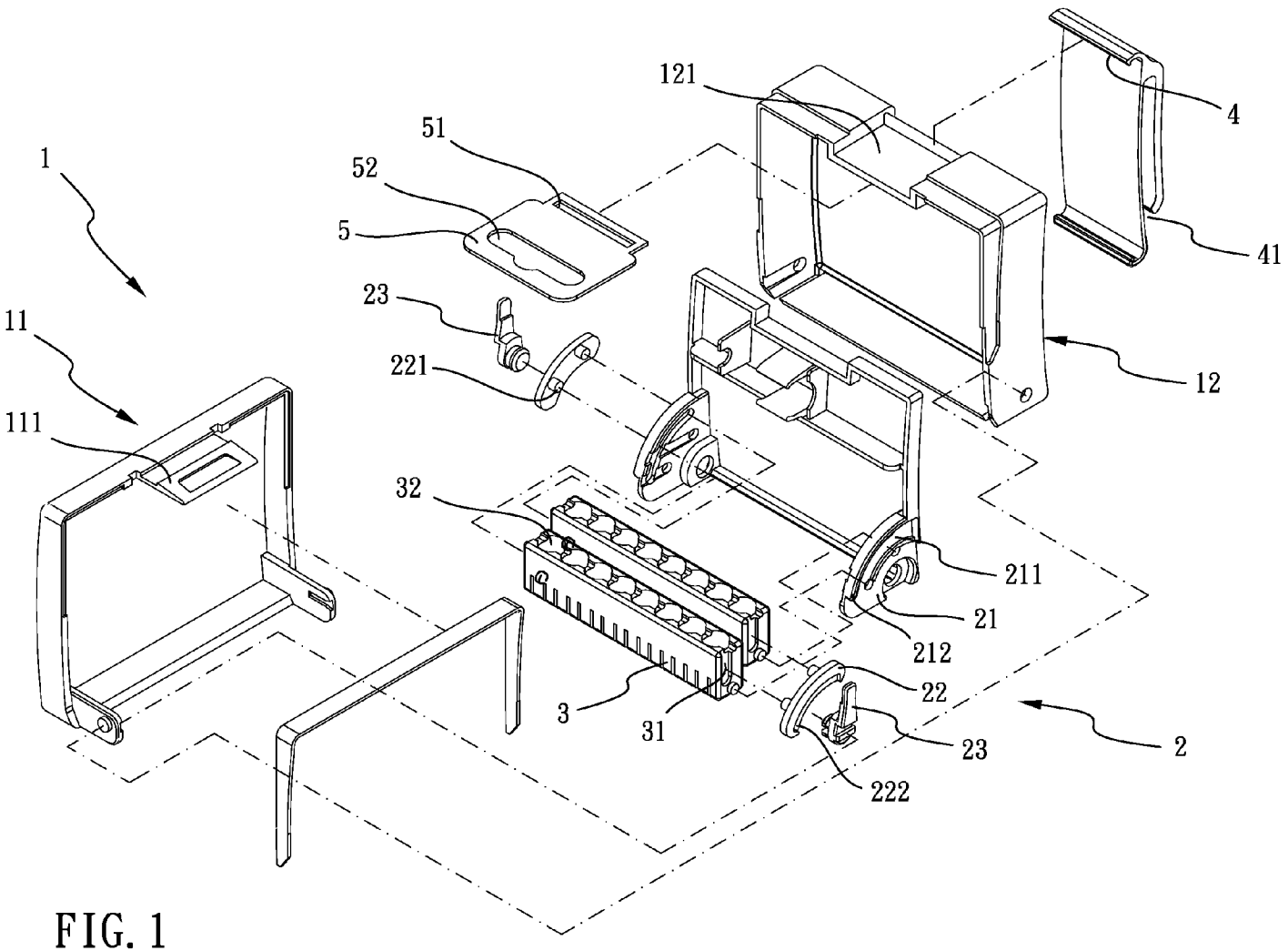
FIG. 1 is an exploded view of a tool box of the present invention.
Figure 2:
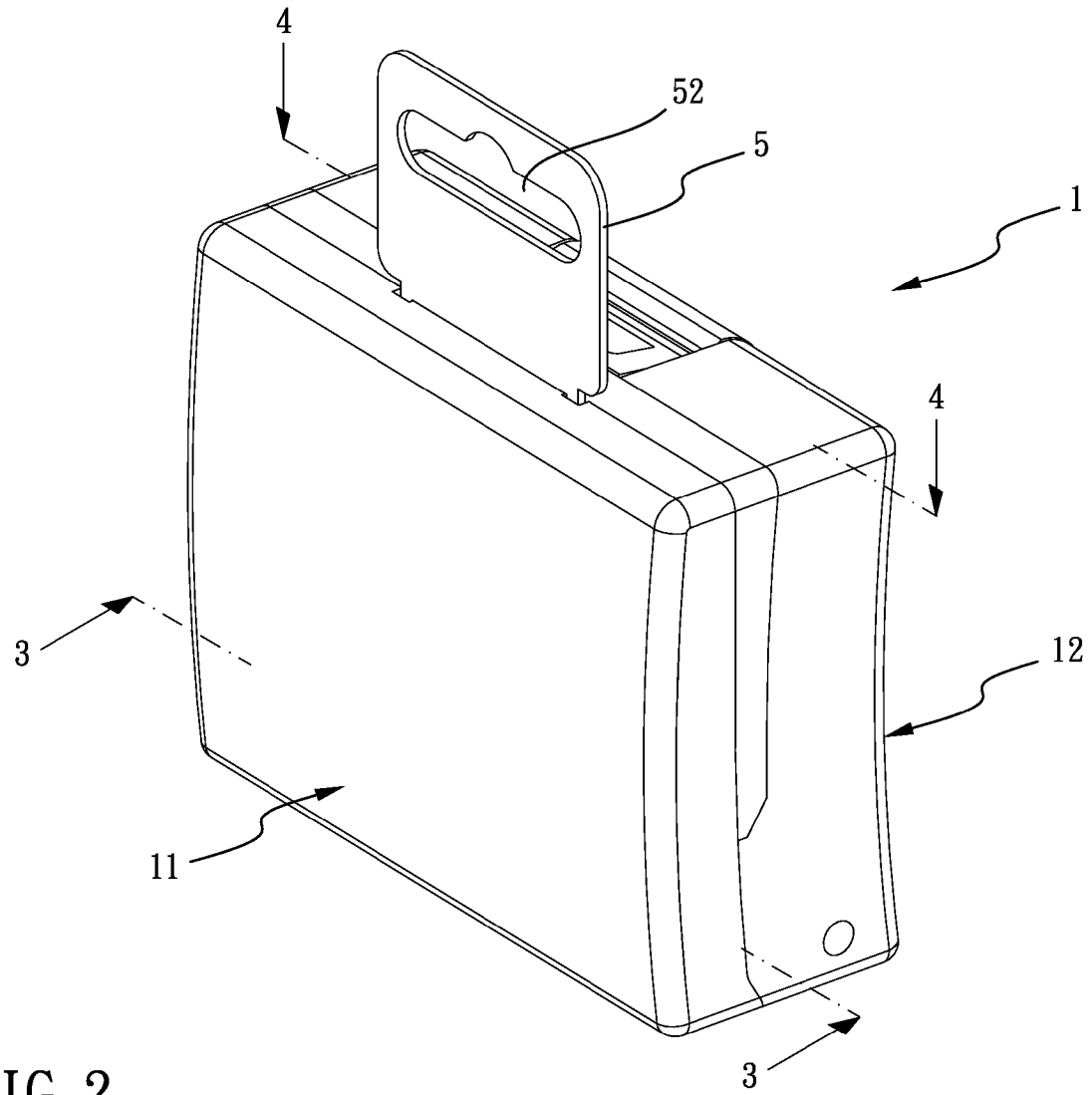
FIG. 2 is an assembled view of the tool box of the present invention.
Figure 3:
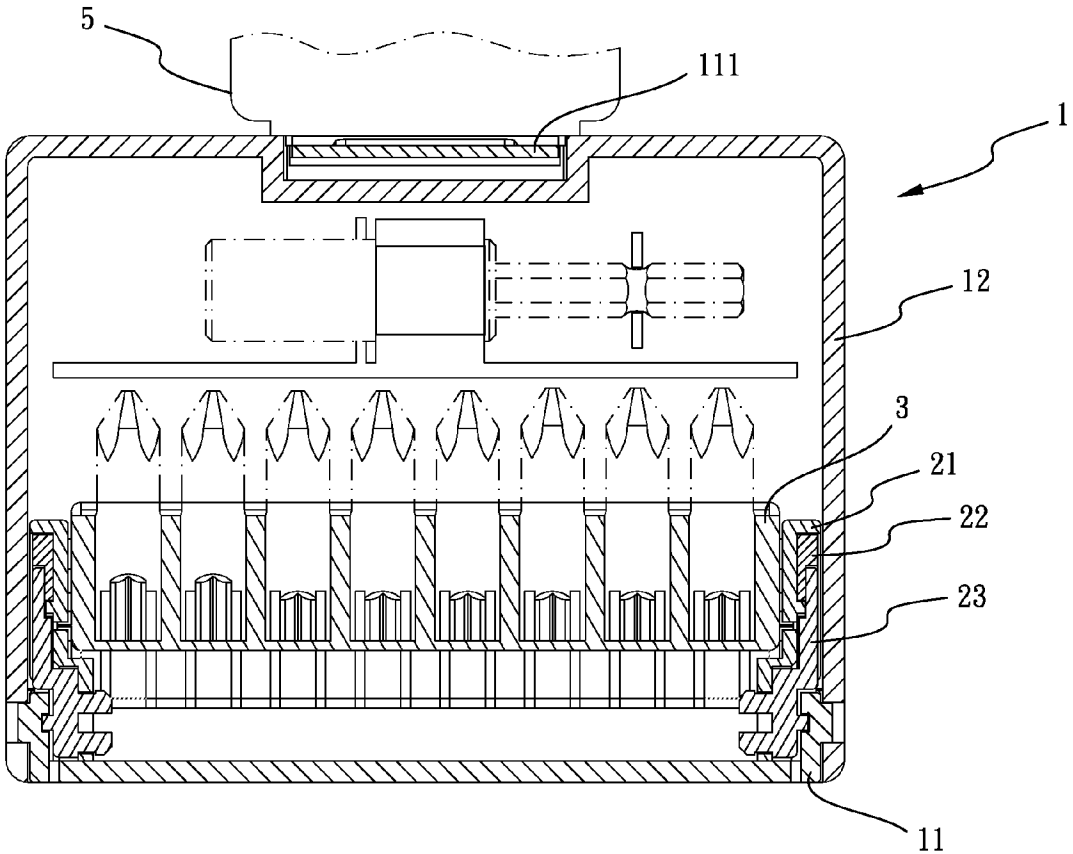
FIG. 3 is a cross-sectional view along a line 3-3 in FIG. 2 for showing a hand tool and tool bits in the tool box.
Figure 4:
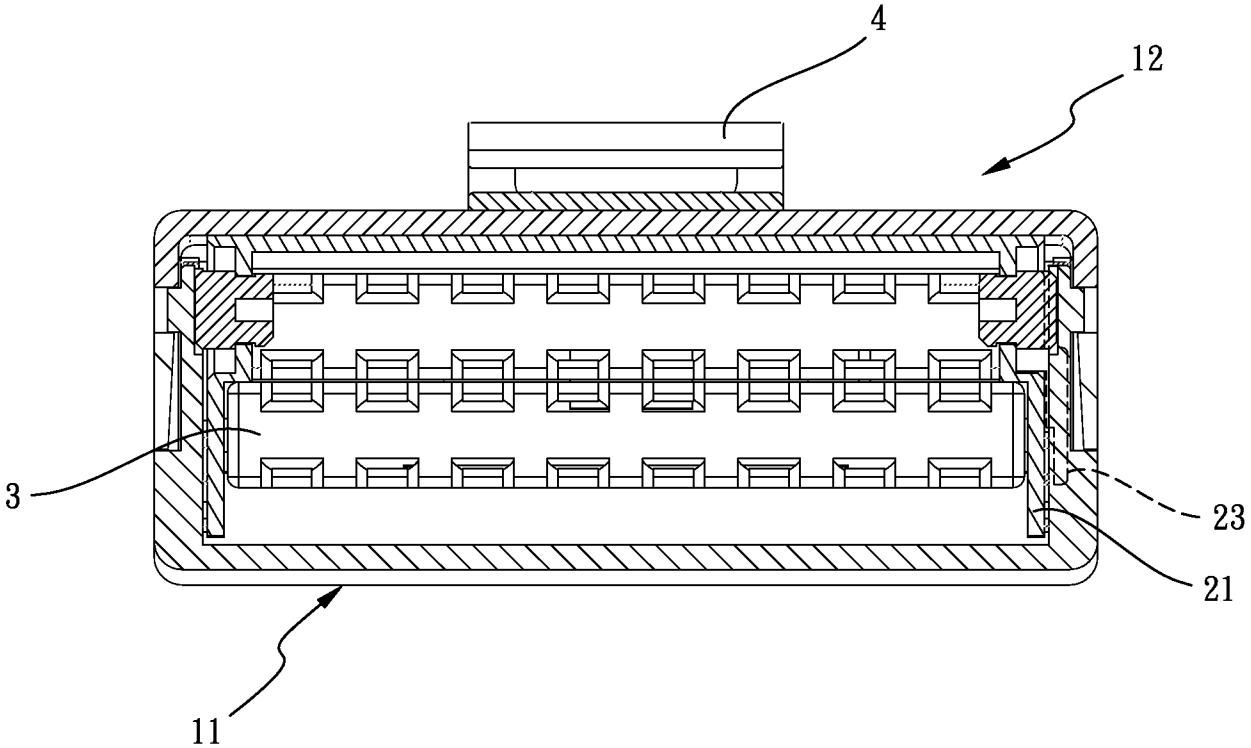
FIG. 4 is a cross-sectional view along a line 4-4 in FIG. 2 for showing a relationship between a box body, a foldable set and a positioning base.

Referring to FIGS. 1-4, a tool box in accordance with the present invention comprises a box body 1, two foldable sets 2 and at least one positioning base 3 (there are two positioning bases 3 in this embodiment). The box body 1 has a top cover 11 and a bottom cover 12 which are pivoting on each other. The top cover 11 has one receiving space defined therein and the bottom cover 12 has another receiving space defined therein (as shown in FIG. 1) so as to receive the positioning base 3, hand tool and tool bits (as shown in FIG. 3). Each foldable set 2 has a guiding plate 21, a sliding member 22 and a pivoting rib 23. The guiding plate 21 is assembled at a pivoting corner (as shown in FIG. 1) of the bottom cover 12. A guiding opening 211 is opened on the guiding plate 21 therethrough. The guiding opening 211 is formed as arc-shaped. Two ends of the positioning base 3 are respectively assembled to the two guiding plates 21. The sliding member 22 is located at one side of the guiding plate 21. The sliding member 22 is formed as arc-shaped. At least one connecting rod 221 is extruded on the sliding member 22. The connecting rod 221 passes through the guiding opening 211 to connect to one end of the positioning base 3. The pivoting rib 23 is located at one side of the guiding plate 21. The pivoting rib 23 is adjacent to the sliding member 22. One end of the pivoting rib 23 is pivoted on the guiding plate 21 at one side thereof and is fixed to the top cover 11 at another side thereof. Another end of the pivoting rib 23 is adjacent to the sliding member 22. The sliding member 22 is movable via the motion of another end of the pivoting rib 23. The above description is enough to perform the priority embodiment of the present invention.

Under this arrangement, when the top cover 11 pivots on the bottom cover 12, the pivoting rib 23 pivots on the guiding plate 21 via the motion of the top cover 11; then the sliding member 22 slides on the guiding plate 21 via the motion of another end of the pivoting rib 23; thereafter the connecting rod 221 of the sliding member 22 moves along the guiding opening 211 of the guiding plate 21; finally the positioning base 3 is rotated outward relative to the bottom cover 12 by the motion of the connecting rod 221. Therefore, when the positioning base 3 is rotated outward relative to the bottom cover 12, a user can pull out the tool bit from the positioning base 3 directly without bending up the tool bit by a finger at first.

Figure 5:
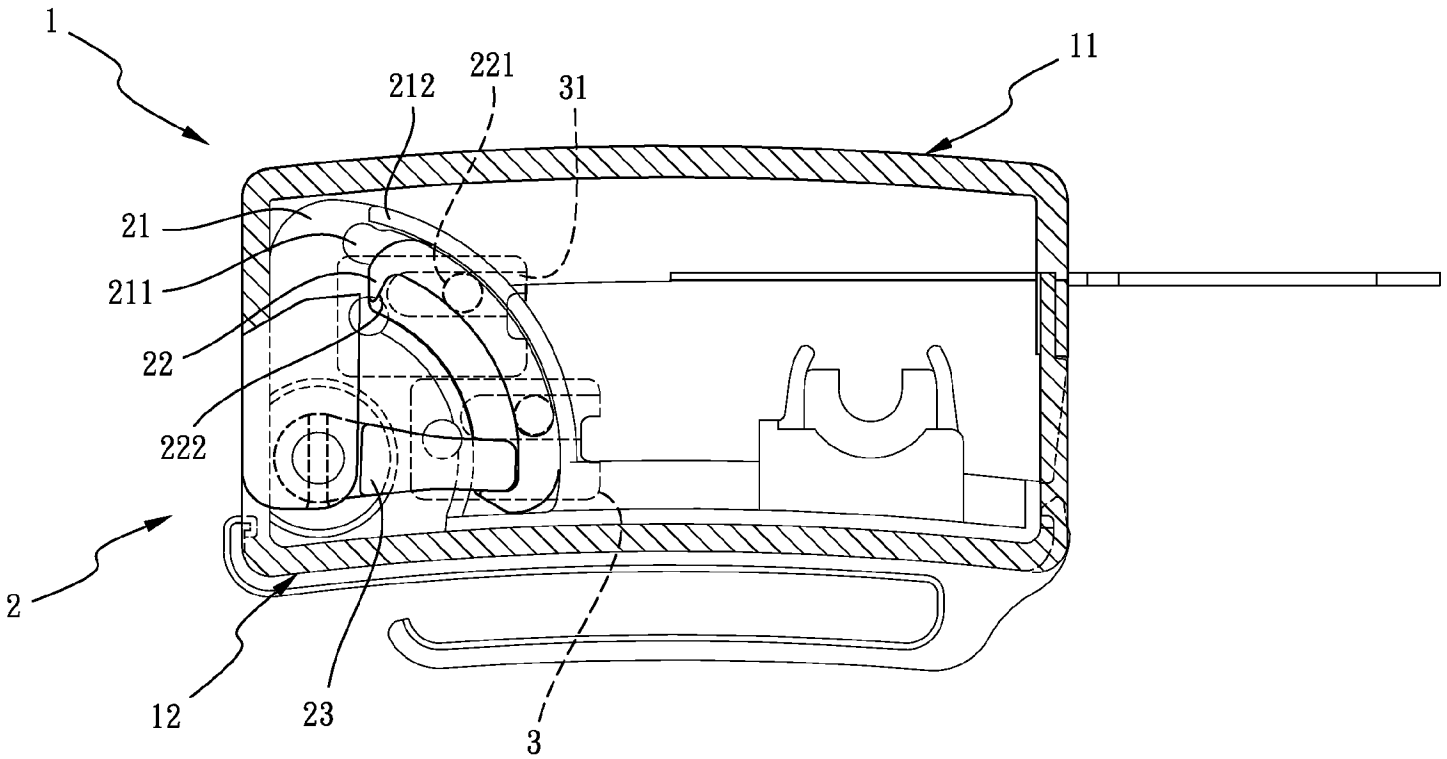
FIG. 5 is a cross-sectional view for showing the tool box which is closed.

Referring to FIGS. 1 and 5, the sliding member 22 further has a guiding groove 222 defined thereon. The guiding groove 222 is formed as arc-shaped. Another end of the pivoting rib 23 is assembled in the guiding groove 222. Another end of the pivoting rib 23 is movable along the guiding groove 222. An abutting protrusion 212 is further extruded along one side of the guiding opening 211 on the guiding plate 21. The abutting protrusion 212 is adjacent to the periphery of the guiding plate 21. The sliding member 22 abuts against the abutting protrusion 212 so as to prevent the connecting rod 221 of the sliding member 22 from derailing from the guiding opening 211 of the guiding plate 21 when the sliding member 22 slides on the guiding plate 21. At least one bar groove 31 is defined at each end of the positioning base 3. The connecting rod 221 which is cylinder-shaped passes through the guiding opening 211 to be inserted into the bar groove 31 of the positioning base 3.

Figure 6:
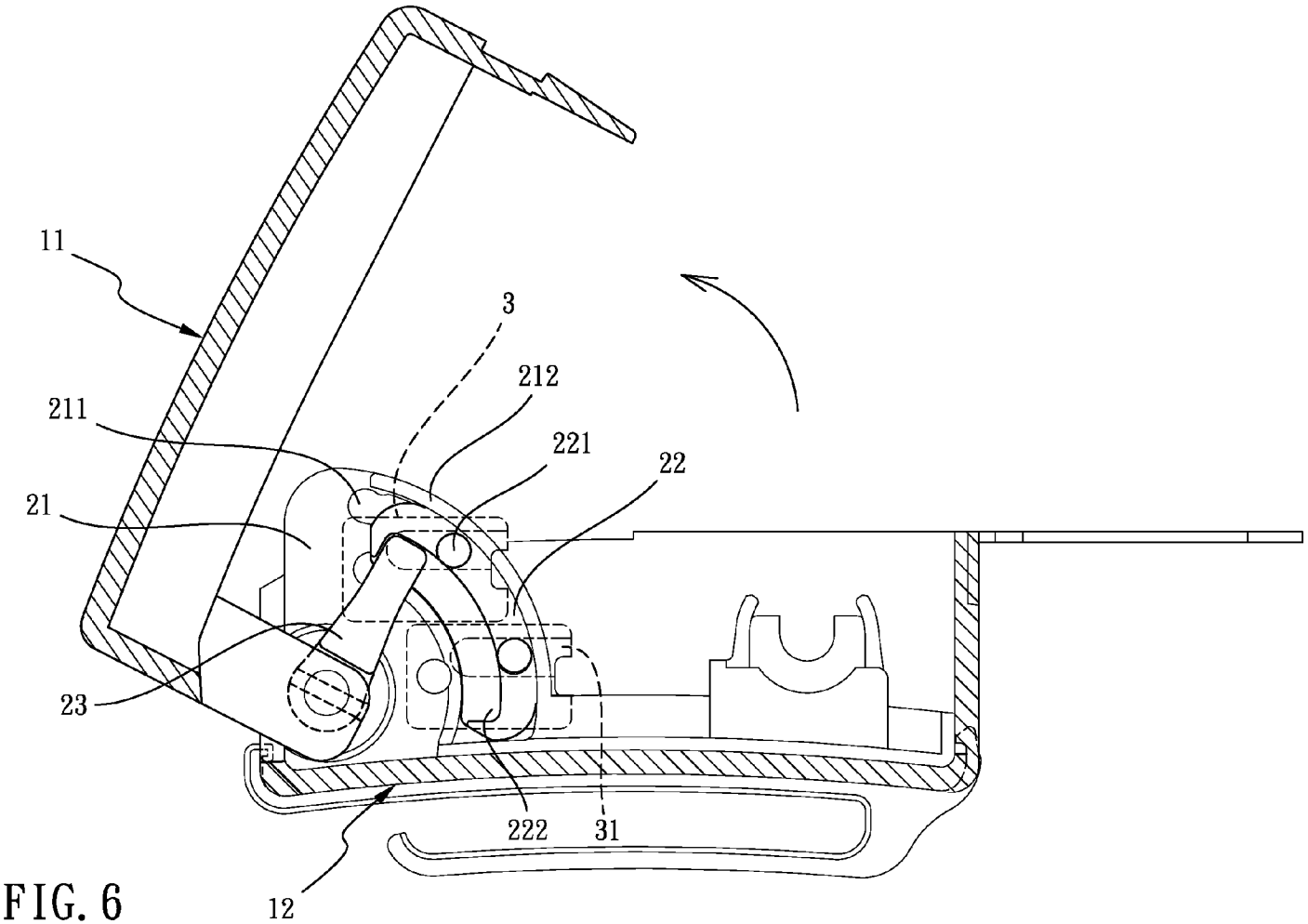
FIG. 6 is a cross-sectional view for showing the tool box to be opening.
Figure 7:
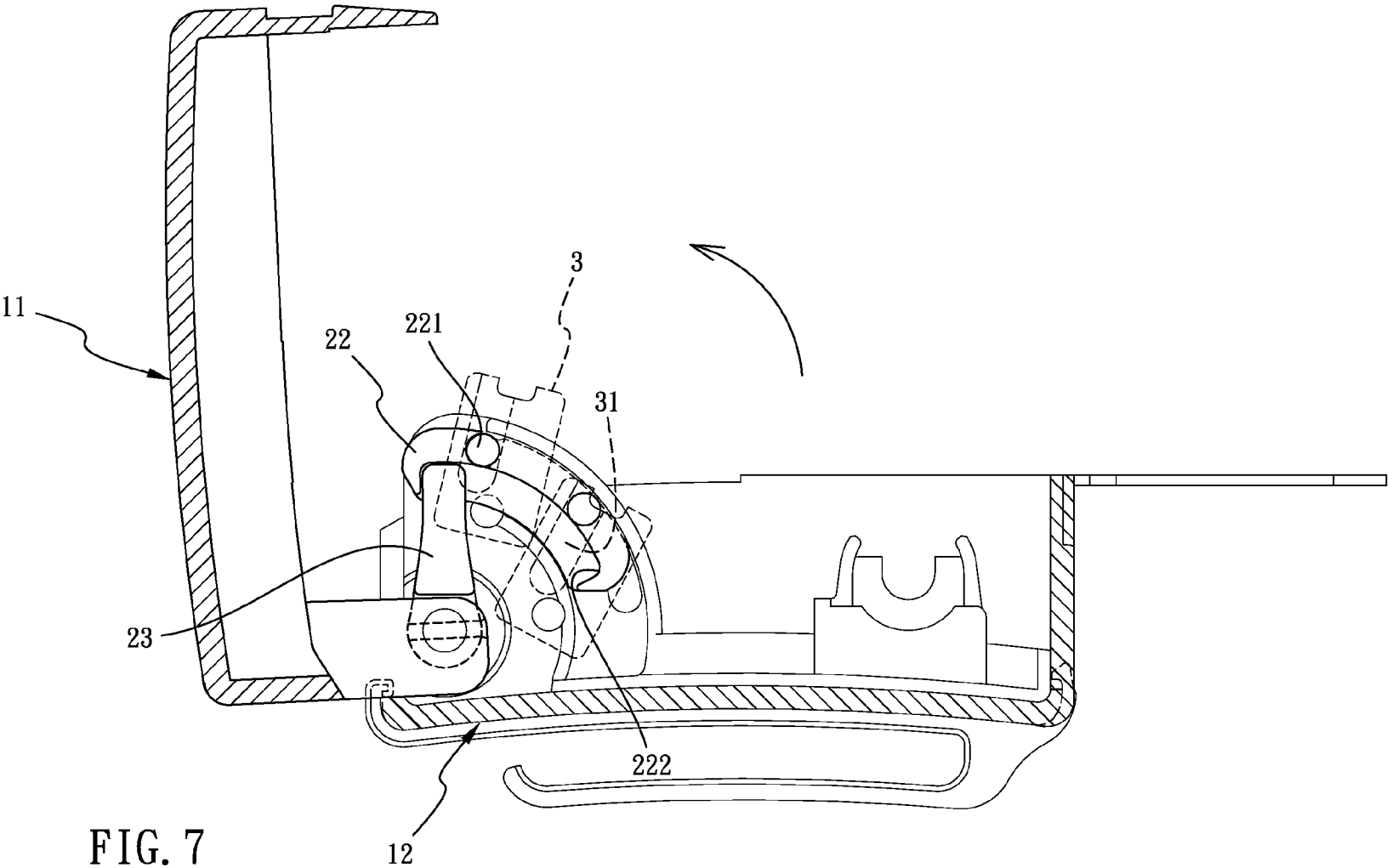
FIG. 7 is a cross-sectional view for showing the tool box which has been completely opened.
Figure 8:
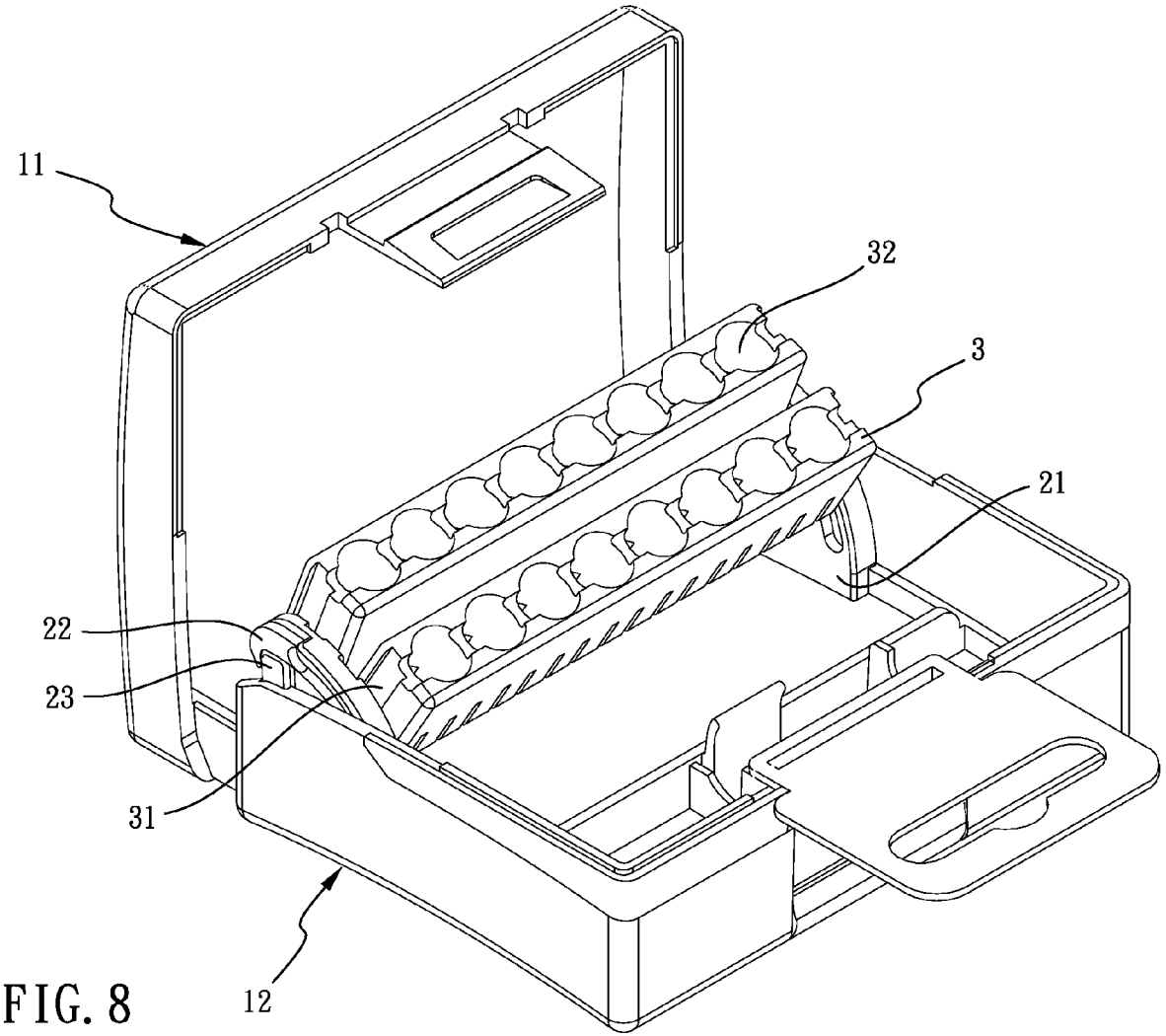
FIG. 8 is a perspective view for showing the tool box which has been completely opened.

Under this arrangement, referring to FIGS. 6-8, when the top cover 11 pivots on the bottom cover 12, another end of the pivoting rib 23 moves along the guiding groove 222 via the motion of the top cover 11 to push against one end wall of the guiding groove 222; then the sliding member 22 is slid along the guiding opening 211 of the guiding plate 21 by another end of the pivoting rib 23; thereafter the connecting rod 221 of the sliding member 22 moves along the guiding opening 211 of the guiding plate 21 to push against one wall of the bar groove 31 of the positioning base 3; finally the positioning base 3 is rotated outward by the connecting rod 221. Therefore, when the positioning base 3 is rotated outward (there are two positioning base 3 which are both rotated outward in the embodiment of the present invention), the user can pull out the tool bit from the positioning base 3 directly without bending up the tool bit by the finger at first.

Furthermore, the positioning base 3 has a plurality of positioning spaces 32. An opening of each positioning space 32 faces toward the top of the bottom cover 12 when the positioning base 3 has not rotated outward yet (as shown in FIGS. 5-6.). The opening of each positioning space 32 faces toward the outside from the bottom cover 12 after the positioning base 3 is rotated outward relative to the bottom cover 12. Referring to FIG. 1, a clipping plate 4 is assembled to the bottom of the bottom cover 12 to make the user more convenient to carry the tool box. A clipping space 41 is defined between one side of the clipping space 41 and the bottom of the bottom cover 12. The user has a belt (not shown) which passes through the clipping space 41 and the user puts on the belt. Therefore, the user carries the tool box on the belt conveniently.

Referring to FIGS. 1-3, a buckle groove 121 is defined on the top of the bottom cover 12. A hanging plate 5 is vertically assembled to the top of the bottom cover 12 and is adjacent to the buckle groove 121. The hanging plate 5 has a through opening 51 opened at a bottom end thereof. The through opening 51 is corresponding to the buckle groove 121. A hanging opening 52 is opened at a top end of the hanging plate 5 therethrough. The top cover 11 has a buckle unit 111 formed at the top thereof. The buckle unit 111 of the top cover 11 is corresponding to the buckle groove 121 of the bottom cover 12. The buckle unit 111 passes through the through opening 51 to be buckled into the buckle groove 121. Therefore, the user can hang the tool box on a hook (not shown) via the hanging opening 52 of the hanging plate 5.

Although the invention has been explained in relation to its preferred embodiment, it is to be understood that many other possible modifications and variations can be made without departing from the spirit and scope of the invention as hereinafter claimed.

What is claimed is:

1. A tool box comprising:

a box body, two foldable sets and at least one positioning base, the box body having a top cover and a bottom cover which are pivoting on each other, each foldable set having a guiding plate, a sliding member and a pivoting rib, the guiding plate is assembled at a pivoting corner of the bottom cover, a guiding opening opened on the guiding plate therethrough and formed as arc-shaped, two ends of the positioning base respectively assembled to the two guiding plates, the sliding member located at one side of the guiding plate, at least one connecting rod extruded on the sliding member, the connecting rod passing through the guiding opening to connect to one end of the positioning base, the pivoting rib located at one side of the guiding plate and being adjacent to the sliding member, one end of the pivoting rib pivoted on the guiding plate at one side thereof and fixed to the top cover at another side thereof, another end of the pivoting rib being adjacent to the sliding member, the sliding member being movable via the motion of another end of the pivoting rib;

wherein, when the top cover pivots on the bottom cover, the pivoting rib pivots on the guiding plate via the motion of the top cover; then the sliding member slides on the guiding plate via the motion of another end of the pivoting rib; thereafter the connecting rod of the sliding member moves along the guiding opening of the guiding plate; finally the positioning base is rotated outward relative to the bottom cover by the motion of the connecting rod.

2. The tool box as claimed in claim 1, wherein a clipping plate is assembled to the bottom of the bottom cover; a clipping space is defined between one side of the clipping space and the bottom of the bottom cover.

3. The tool box as claimed in claim 1, wherein a buckle groove is defined on the top of the bottom cover; a hanging plate is assembled to the top of the bottom cover; the hanging plate has a through opening opened at a bottom end thereof; the through opening is corresponding to the buckle groove; a hanging opening is opened at a top end of the hanging plate therethrough; the top cover has a buckle unit which is corresponding to the buckle groove of the bottom cover; the buckle unit passes through the through opening to be buckled into the buckle groove.

4. The tool box as claimed in claim 1, wherein the sliding member further has a guiding groove defined thereon; the guiding groove is formed as arc-shaped; another end of the pivoting rib is assembled in the guiding groove.

5. The tool box as claimed in claim 1, wherein at least one bar groove is defined at each end of the positioning base; the connecting rod passes through the guiding opening to be inserted into the bar groove of the positioning base.

6. The tool box as claimed in claim 4, wherein at least one bar groove is defined at each end of the positioning base; the connecting rod passes through the guiding opening to be inserted into the bar groove of the positioning base.

7. The tool box as claimed in claim 1, wherein an abutting protrusion is further extruded along one side of the guiding opening on the guiding plate; the abutting protrusion is adjacent to the periphery of the guiding plate; the sliding member abuts against the abutting protrusion.

8. The tool box as claimed in claim 4, wherein an abutting protrusion is further extruded along one side of the guiding opening on the guiding plate; the abutting protrusion is adjacent to the periphery of the guiding plate; the sliding member abuts against the abutting protrusion.

9. The tool box as claimed in claim 5, wherein an abutting protrusion is further extruded along one side of the guiding opening on the guiding plate; the abutting protrusion is adjacent to the periphery of the guiding plate; the sliding member abuts against the abutting protrusion.

* * * * *